US007523853B2

(12) United States Patent
Kortsmit et al.

(10) Patent No.: US 7,523,853 B2
(45) Date of Patent: Apr. 28, 2009

(54) CARTON AND BLANK FOR CARTON WITH CORNER INDENT WALL

(75) Inventors: Peter Kortsmit, Mahtomedi, MN (US); Tommy Ljungstrom, Hoor (SE)

(73) Assignee: Tetra Laval Holdings & Finance. S.A., Pully (CH)

( * ) Notice: Subject to any disclaimer, the term of this patent is extended or adjusted under 35 U.S.C. 154(b) by 0 days.

(21) Appl. No.: 11/754,819

(22) Filed: May 29, 2007

(65) Prior Publication Data

US 2008/0296359 A1 Dec. 4, 2008

(51) Int. Cl.
*B65D 5/08* (2006.01)
*B65D 5/74* (2006.01)

(52) U.S. Cl. ..... 229/108; 229/116.1; 229/125.42; 229/137

(58) Field of Classification Search ..... 229/108, 229/116.1, 125.42, 213, 214, 249, 137
See application file for complete search history.

(56) References Cited

U.S. PATENT DOCUMENTS

| | | | | |
|---|---|---|---|---|
| 2,119,382 A | | 5/1938 | Cooper | |
| D208,272 S | | 8/1967 | Corella | |
| 3,610,514 A | | 10/1971 | Samsing | |
| D244,993 S | | 7/1977 | Drysdale | |
| 4,126,266 A | | 11/1978 | Roccaforte | |
| 4,313,556 A | | 2/1982 | Boyle et al. | |
| D268,328 S | | 3/1983 | Lovett, Jr. | |
| 4,483,464 A | | 11/1984 | Nomura | |
| 4,714,164 A | * | 12/1987 | Bachner | 229/249 |
| 4,728,002 A | | 3/1988 | Ybanez | |
| 4,846,396 A | | 7/1989 | Palazzolo | |
| 4,964,562 A | | 10/1990 | Gordon | |

(Continued)

FOREIGN PATENT DOCUMENTS

JP 2000289736 9/2008

(Continued)

OTHER PUBLICATIONS

Portion Package for Pourable Food Products (Oct. 1998).

*Primary Examiner*—Gary E Elkins
(74) *Attorney, Agent, or Firm*—Levenfeld Pearlstein, LLC

(57) ABSTRACT

A package having a corner indent wall includes a plurality of upstanding side walls including a first side wall, a front wall, a rear wall, a second side wall and an indent wall. The first side wall is contiguous with the front wall, the front wall is contiguous with the indent wall which is contiguous with the second side wall, the second side wall is contiguous with the rear wall and the rear wall is sealed to the first side wall. The package includes a sealed bottom wall formed from a plurality of bottom wall panels, each bottom wall panel adjacent a corresponding side wall. The package includes a gable top formed from a plurality of gable panels contiguous with their adjacent gable panels and their respective side walls and separated form their respective side walls by an upper crease line. The upper crease line is straight as separating two of the gable panels from their respective side walls and is curved downwardly as separating two of the gable panels from their respective side walls. The carton can be formed symmetrical and asymmetrical. A blank for the carton is disclosed.

11 Claims, 4 Drawing Sheets

U.S. PATENT DOCUMENTS

| | | | | |
|---|---|---|---|---|
| D347,169 | S | | 5/1994 | Bezzerides et al. |
| D364,815 | S | | 12/1995 | Wallace |
| 5,474,232 | A | | 12/1995 | Ljungstrom et al. |
| 5,636,785 | A | | 6/1997 | Kalberer et al. |
| D389,055 | S | | 1/1998 | Seo et al. |
| D391,847 | S | | 3/1998 | Seo et al. |
| 5,738,272 | A | | 4/1998 | Anchor et al. |
| 5,803,349 | A | | 9/1998 | Ljungstrom et al. |
| 5,860,586 | A | * | 1/1999 | Anchor et al. ..... 229/213 |
| 5,938,107 | A | | 8/1999 | Anchor et al. |
| 6,027,016 | A | | 2/2000 | Ljunstrom et al. |
| D436,032 | S | | 1/2001 | Croft et al. |
| D437,218 | S | | 2/2001 | Ljunstrom et al. |
| D451,387 | S | | 12/2001 | Miller |
| D455,075 | S | | 4/2002 | Campbell |
| D460,355 | S | | 7/2002 | Lenz et al. |
| D468,638 | S | | 1/2003 | Nogami et al. |
| D494,861 | S | | 8/2004 | Guidotti et al. |
| D513,177 | S | | 12/2005 | Tachikawa et al. |
| D518,368 | S | | 4/2006 | Tachikawa et al. |
| D518,371 | S | | 4/2006 | Franic |
| D521,373 | S | | 5/2006 | Stanton |
| D521,376 | S | | 5/2006 | Mosto |
| 7,036,717 | B2 | | 5/2006 | Furini et al. |
| D527,629 | S | | 9/2006 | Franic |
| D540,164 | S | | 4/2007 | Franic |
| 2006/0144912 | A1 | | 7/2006 | Franic |

FOREIGN PATENT DOCUMENTS

| | | |
|---|---|---|
| WO | DM064703 | 7/2003 |
| WO | WO2004076302 | 9/2004 |
| WO | DM066503 | 12/2004 |

* cited by examiner

CARTON AND BLANK FOR CARTON WITH CORNER INDENT WALL

BACKGROUND OF THE INVENTION

The present invention pertains to a carton blank. More particularly, the present invention pertains to a carton blank for a carton having a corner indent wall in a vertical edge of the carton.

One common form of container for milk, juice and the like is the gable top carton. Recently, packaging technology has made enormous strides vis-à-vis these gable top cartons, as well as other types of packages. At present, technology permits packaging perishable food items for non-refrigerated extended shelf lives. These packages provide the ability to bring these food items into parts of the world that have limited transportation, distribution and storage infrastructure.

Many such gable top carton appear quite similar. Typically, they have four upstanding side walls that are generally rectangular panels that are closed by a gable-shaped top. The typical gable top has equal-sized front and rear gable panels that are joined by a sealed top fin. The front panel can include a closure, such as a spout mounted to the panel to facilitate access to the contents of the carton. A threaded cap can be fitted to the spout to close the package.

One modified type of carton, such as that disclosed in Ljungstrom, U.S. Pat. No. 6,182,887, which is commonly assigned with the present application and is incorporated herein by reference, includes an elongated front panel to permit use of an enlarged closure spout and cap.

Other cartons are formed having novel shapes to differentiate the appearance of cartons and to provide an easy handling carton. One such carton is disclosed in Ljungstrom, U.S. Pat. No. 6,027,016, also commonly assigned with the present application and incorporated herein by reference, in which the carton includes beveled corners at the intersection of the panels.

Accordingly, there is a need for a unique carton configuration that provides differentiation among gable top cartons. Desirably, such a carton configuration provides a carton that is easily gripped and handled, to dispense the contents from the carton. More desirably, such a carton is configured with no significant adverse impact on the capacity (volume) of the carton, with no increase in carton footprint, and no increase in materials needed to fabricate the carton.

BRIEF SUMMARY OF THE INVENTION

A gable top package has a corner indent wall. The package includes a plurality of upstanding side walls including a first side wall, a front wall, a rear wall, a second side wall and a corner indent wall. The first side wall is contiguous with the front wall, which is contiguous with the crease wall which is contiguous with the second side wall which is contiguous with the rear wall. The rear wall is sealed to the first side wall. The corner indent wall extends the length of the package.

A sealed bottom wall is formed from a plurality of bottom wall panels. Each bottom wall panel is adjacent a corresponding side wall. The gable top is formed from a plurality of gable panels contiguous with their adjacent gable panels and their respective side walls. The gable panels are separated form their respective side walls by an upper crease line. The upper crease line is straight as separating two of the gable panels from their respective side walls and is curved downwardly as separating two of the gable panels from their respective side walls. The gable top includes a sealed top fin.

In one embodiment, a symmetrical carton, the straight upper crease lines are formed perpendicular to a crease line between two adjacent side walls. In another embodiment, an asymmetrical carton, the straight upper crease lines are formed at an angle other than 90 degrees to a crease line between two adjacent side walls.

The curved upper crease lines are formed between the front wall and its corresponding gable panel and the second side wall and its corresponding gable panel. An intersection of the curved crease lines also substantially intersects the creases that define the corner indent wall.

A blank for that carton includes a first side wall panel, a front wall panel, a corner indent wall panel, a second side wall panel and a rear wall panel, a vertical crease line partitioning the first side wall panel from the front wall panel and a vertical crease line separating the second side wall panel from the rear wall panel. The blank includes a pair of opposing, mirror image, symmetrical arcuate corner indent wall panel crease lines that separate the corner indent wall from the front wall and the second side wall, respectively.

A plurality of bottom wall panels are formed adjacent to and contiguous with the front, rear and side wall panels. The bottom wall panels are partitioned from their adjacent bottom wall panels by the vertical crease lines and separated from their respective side wall panels by a lower horizontal crease line. The bottom wall panels include a leading panel, a pair of opposing gusset panels, a trailing panel and a sixth panel contiguous with the trailing panel.

A plurality of top panels are formed adjacent to and contiguous with the front, rear and side wall panels. The top panels are partitioned from their adjacent top panels by the vertical crease lines, the first side wall panel and the rear panel are separated from their respective top panels by straight crease lines and the front wall panel and second side wall panel are separated from their respective top panels by concave curved crease lines.

The corner indent wall panel crease lines intersect with one another and with the lower horizontal crease line and with the concave curved crease lines separating the front wall panel and second side wall panel from their respective top panels.

The blank can include an opening therein to receive, for example, a closure.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
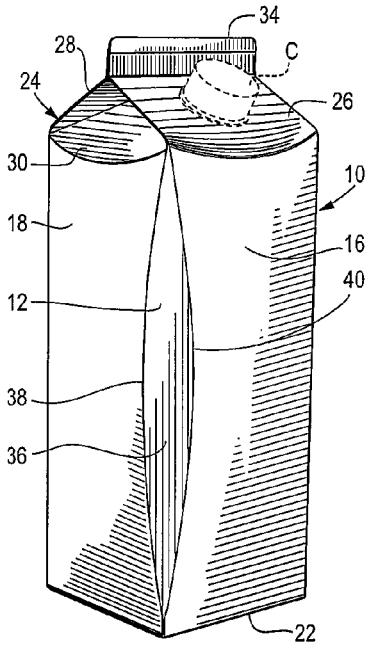
FIG. 1 is a perspective view of one embodiment of a carton with corner indent wall embodying the principles of the present invention.
Figure 2A:
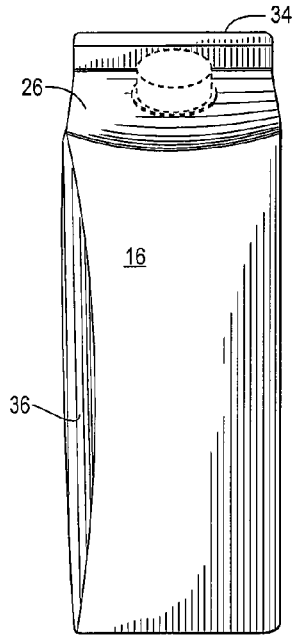
FIGS. 2A-2D are front, rear and side views of the carton of FIG. 1.
Figure 2B:
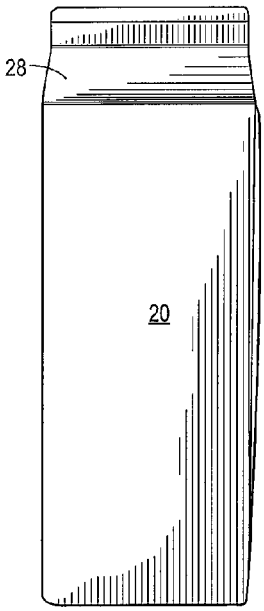
Figure 2C:
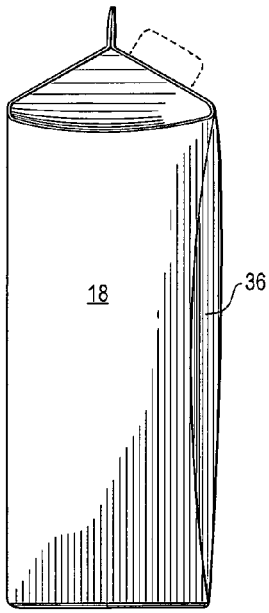
Figure 2D:
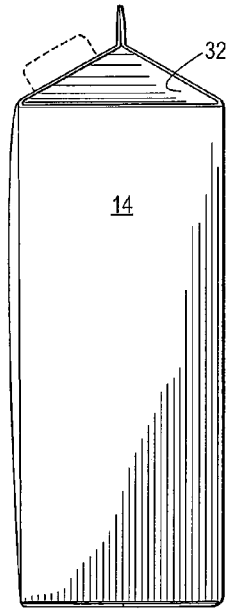

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

An embodiment of the package with corner indent wall 10 in accordance with the principles of the present invention is illustrated in FIG. 1. The illustrated package 10 is a symmetrical package in that other than the corner indent wall 12, the two halves of each panel defined by a longitudinal line through the panel are mirror images of one another (see, e.g., lines 13*a*, 13*b* in FIG. 3).

The package 10 includes, generally, a first side wall 14, a front wall 16, a second side wall 18, a rear wall 20, a sealed bottom wall 22, and the familiar gable top 24 that is defined by front and rear top panels 26, 28, top infolded or side gable panels 30, 32, and a top fin 34. A longitudinal side seal wall (see FIG. 3) is formed adjacent the first side wall 14 for sealing to, for example the rear wall 20, to form the tubular carton form.

The corner indent (indicated generally at 12) is formed by a wall 36 that is apportioned from a portion of the front wall 16 and the second side wall 18 and is defined by opposing, mirror image, symmetrical, arcuate crease lines 38, 40. The corner indent wall 36 extends the entire length of the package (the length of the front 16 and side walls 14, 18) from the bottom wall 22 to the gable 24.

Figure 3:
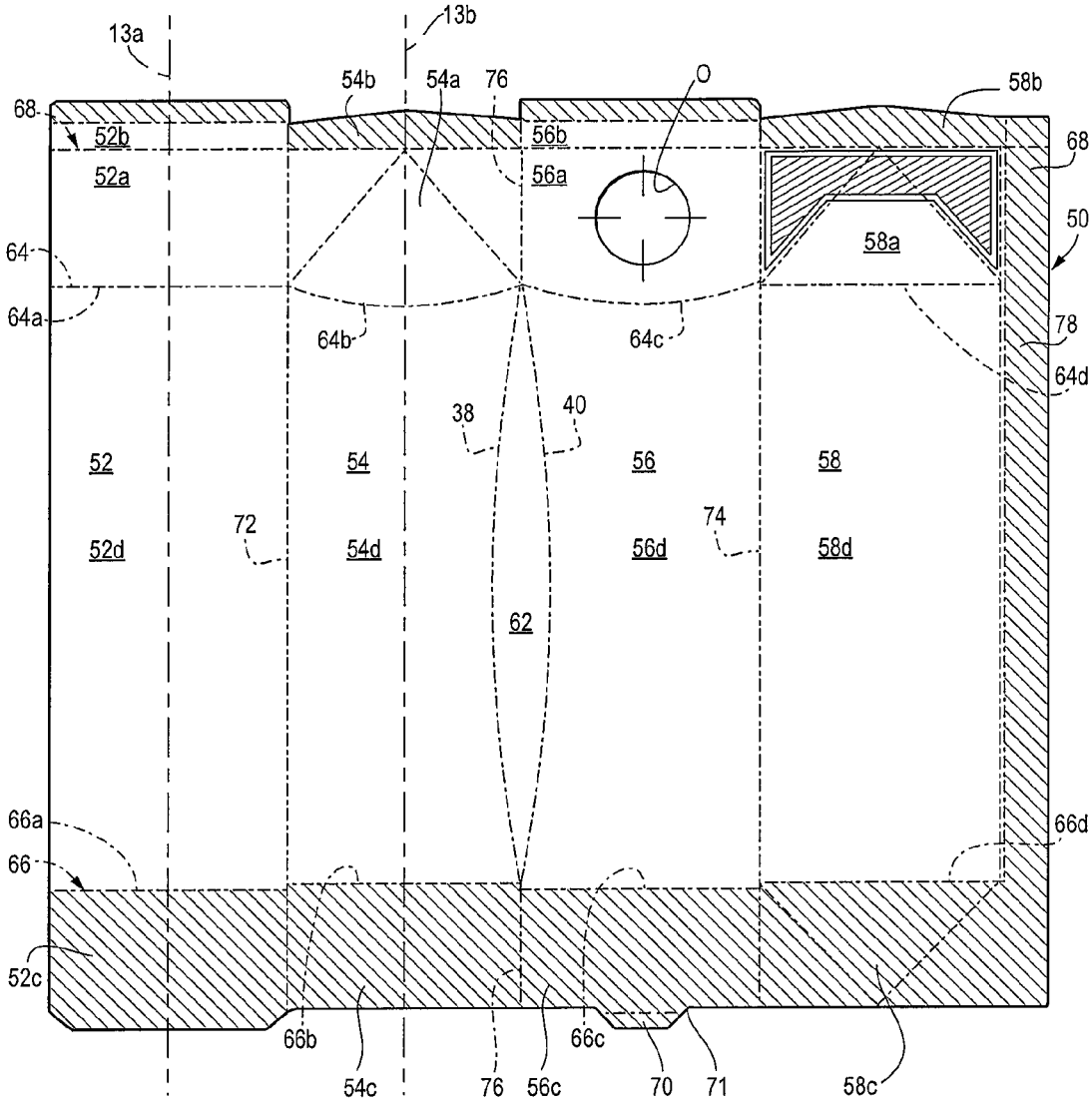
FIG. 3 is a plan view of a carton blank for the carton of FIGS. 1 and 2.

A blank 50 for the carton 10 is illustrated in FIG. 3. The blank 10 includes a first panel 52 that defines in part the rear wall 20, a second panel 54 that defines in part the second side wall 18, a third panel 56 that defines in part the front wall 16, a fourth panel 58 that defines in part the first side wall 14, a fifth panel 68 that is sealed to the first panel 52 to form the tubular carton form and a corner indent wall panel 62 between the second 54 and third 56 panels (between the second side wall 18 and the front wall 16). The panels 52-62 are contiguous with their adjacent panels.

The upper portions of the panels 52-60 (those that make up the gable top 24) are separated from middle portions by an upper transverse crease line 64 and the lower portions of the panels 52-60 (those that make up the bottom wall 22) are separated from the middle portions by a lower transverse crease line 66. The lower crease 66 is a straight, linear crease (with two minor steps at the side walls 54, 58). The upper crease 64, however, includes curved profiles 64*b*, 64*c* at the front 56 and second side 54 panels that are adjacent to the corner indent wall panel 62. The upper crease 64 is straight (and horizontal) across the rear panel (as at 64*a*) and the first side panel (as at 64*d*), and these crease portions 64*a*, 64*d* are parallel and in the present embodiment 10, collinear with one another. The upper portions of the panels 52*a*-60*a* correspond to the front and rear slanted gable walls 26, 28 and the inwardly oriented (infolded) gable walls 30, 32.

The upper panel portions include fin panels 52*b*-60*b* that are separated from the gable panels 52*a*-60*a* by a linear horizontal crease line 68. The inwardly oriented gable wall fin panels 54*b*, 58*b* are folded in, in respect of forming the gable 24 and are positioned between the rear and front fin panels 52*b*, 56*b* when sealed. Front gable panel 56*b* can include an opening O to accommodate a closure (such as a flange, spout and cap assembly). The cap C is shown in FIG. 1.

Referring now to the bottom wall panels, these include the lower panel portions, below the lower crease line 66. The bottom panels are flat, planar panels and include a major or leading panel 52*c* and a minor or trailing panel 56*c*. The bottom side panels 54*c*, 58*c* are formed from generally triangular panel sections that are infolded to form the bottom 22.

The minor bottom panel 56*c* includes a tab 70 that extends from about a lower-most edge of the panel 56*c*. The tab 70 projects the raw edge (indicated at 71) location away from the interior of the carton when the bottom panels 52*c*-58*c* are in-folded and sealed to form the constructed carton bottom 22.

The entire rear panel 52 (including the gable 52*a*, fin 52*b* and bottom wall 52*c* panels) is separated from the entirety of the second side wall panel 54 by a longitudinal crease line 72. Likewise, the entirety of the front panel 56 is separated from the first side wall panel 58 by a longitudinal crease line 74.

The second side wall panel 54 is separated from the front panel 56 by a longitudinal crease line 76 at the bottom panels 54*c*, 56*c* and the gable panels 54*a*, 56*a*, but the second side wall panel central portion 54*d* is separated from the front wall panel central portion 56*d* by the corner indent wall panel 62 and crease lines 38, 40 above the bottom panels 54*c*, 56*c* and below the gable panels 54*a*, 56*a*. The first side wall panel 58 is separated from seal panel 60 by a longitudinal crease line 78 that extends the entirety of the panel 58, 60.

Figure 4:
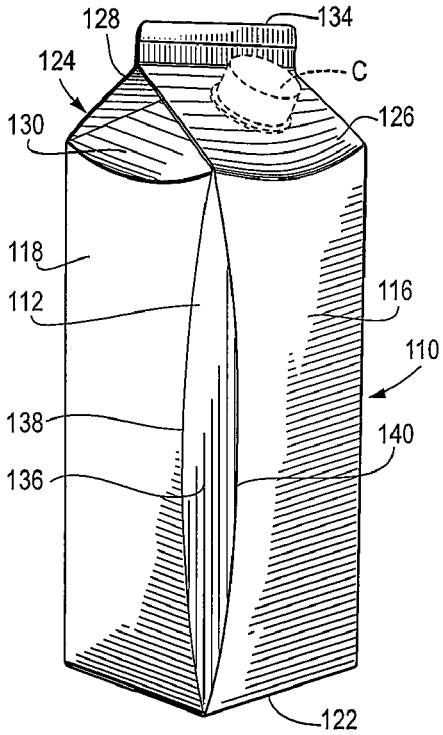
FIG. 4 is a perspective view of another embodiment of a carton with a corner indent wall.
Figure 5A:
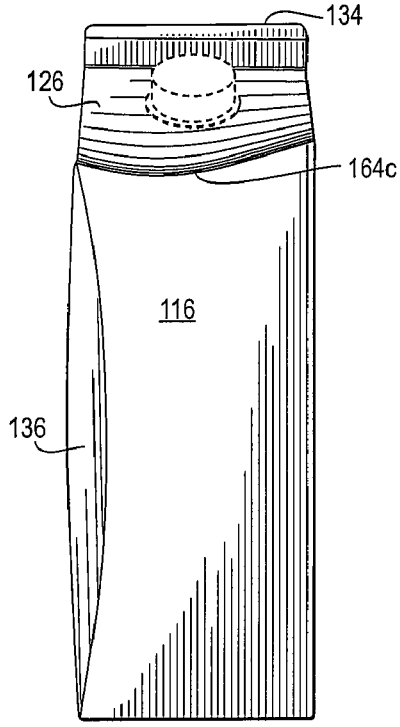
FIGS. 5A-5D are front, rear and side views of the carton of FIG. 4.
Figure 5B:
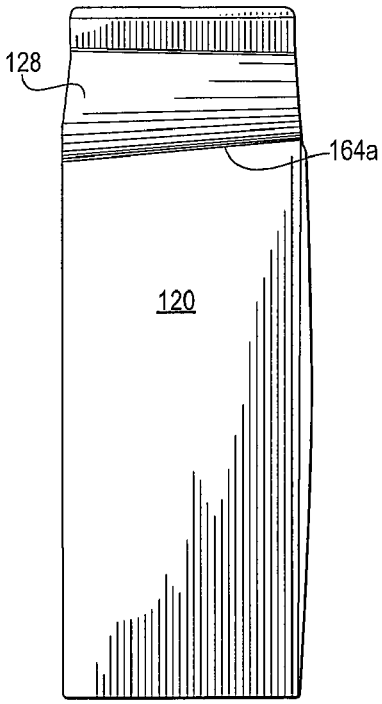
Figure 5C:
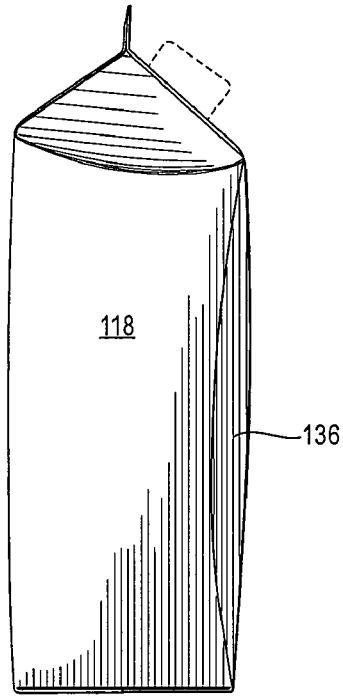
Figure 5D:
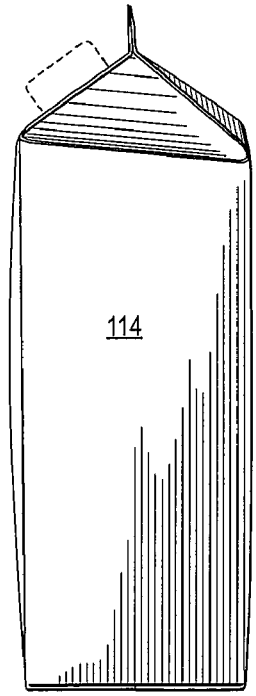
Figure 6:
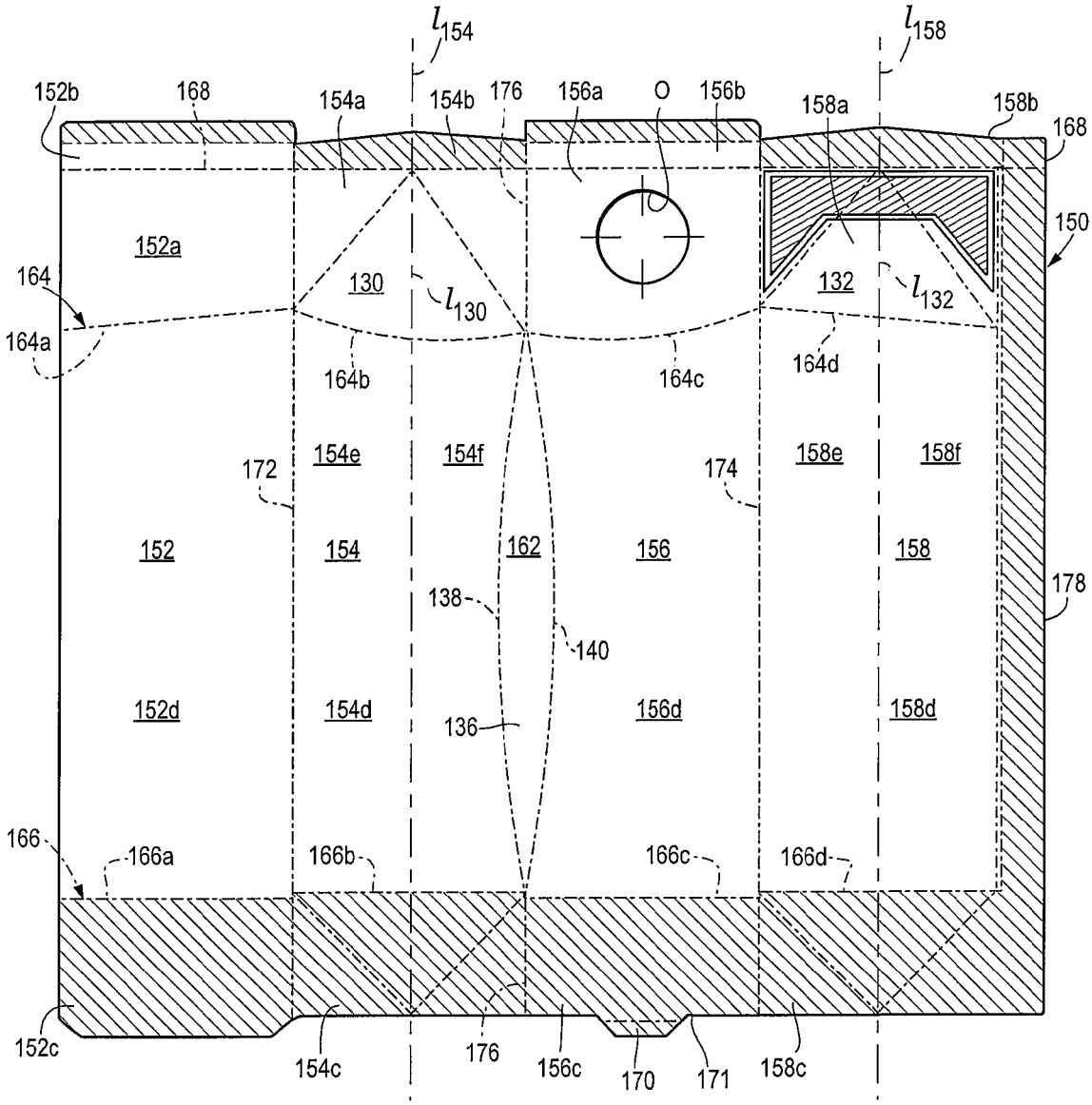
FIG. 6 is a plan view of a carton blank for the carton of FIGS. 4 and 5.

An alternate embodiment of the carton 110 and blank 150 are shown in FIGS. 4-6. In this embodiment, which is an asymmetrical carton, none of the carton panels or carton panel halves are identical to or mirror images of one another. For example, panel halves 154*e* and 154*f* are asymmetrical about line $\mathbf{1}_{154}$ and panel halves 158*e* and 158*f* are asymmetrical about line $\mathbf{1}_{158}$. As seen, the rear wall 120 of the carton 110 has an inclined or slanted upper crease line 164*a* (the crease line that separates the center rear wall panel 152*d* from the gable panel 152*a*). The second side panel and front panel upper crease lines 164*b*, 164*c*, like the previous embodiment, are curved (on either side of the indent wall panel 136, 162) and the first side wall upper crease line 164*d* is also inclined or slanted. Accordingly, the top gable panels 152*a*-158*a* are formed from a curved bottom triangular panel crease 164*b*, 164*c* or a slanted bottom triangular panel crease 164*a*, 164*d*. As such, the triangular panels 130, 132 are asymmetrical (e.g., about lines $\mathbf{1}_{130}$ and $\mathbf{1}_{132}$) and the front upper panel 126 has a curved and sloped lower crease line 164*c* (and is thus also asymmetrical). The straight crease lines 164*a*, 164*d* at the rear and first side wall panels 152, 158 are at an angle to one another.

The corner indent wall 162 and wall creases 138, 140 are, however, symmetrical and extend from the gable 124 to the bottom wall 122 of the carton 110. The lower portions of the cartons, that is portions of the cartons below the lower crease lines 166 are the same as that of the embodiment 10 of FIGS. 1-3. Because of the symmetry of the corner indent walls 62, 162 (relative to the walls 16, 18 and 116, 118), the indent walls 62, 162 are at about 45 degrees to their adjacent walls 16, 18 and 116, 118.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A package having a corner indent wall, comprising:

a plurality of upstanding side walls including a first side wall, a front wall, a rear wall, a second side wall and an indent wall, the first side wall contiguous with the front wall, the front wall contiguous with the indent wall which is contiguous with the second side wall, the second side wall contiguous with the rear wall, the rear wall sealed to the first side wall;

a sealed bottom wall, the bottom wall formed from a plurality of bottom wall panels, each bottom wall panel adjacent a corresponding side wall; and a gable top, the gable top formed from a plurality of gable panels contiguous with their adjacent gable panels and their respective side walls and separated from their respective side walls by an upper crease line, the upper crease line being straight as separating two of the gable panels from their respective side walls and being curved downwardly as separating two of the gable panels from their respective side walls, the gable top including a sealed top fin, wherein the curved upper crease lines are formed between the front wall and its corresponding gable panel and the second side wall and its corresponding gable panel, an intersection of the curved crease lines also substantially intersecting creases defining the indent wall.

2. The package in accordance with claim 1 wherein the straight upper crease lines are formed perpendicular to a crease line between two of the side walls which are adjacent.

3. The package in accordance with claim 1 wherein the straight upper crease lines are formed at an angle other than 90 degrees to a crease line between two of the side walls which are adjacent.

4. The package in accordance with claim 1 wherein an upper end of the creases defining the indent wall substantially intersect a juncture of the front wall, second side wall and indent wall with the gable top.

5. The package in accordance with claim 1 wherein a lower end of the creases defining the indent wall substantially intersect a juncture of the front wall, second side wall and indent wall with the bottom wall.

6. A blank for a carton of the type having a plurality of upstanding side walls including a corner indent wall, each contiguous or sealed to its adjacent side wall and a sealed bottom wall and a gable top, the blank comprising:

a first side wall panel, a front wall panel, an indent wall panel, a second side wall panel and a rear wall panel, a vertical crease line partitioning the first side wall panel from the front wall panel and a vertical crease line separating the second side wall panel from the rear wall panel, a pair of opposing, mirror image, symmetrical arcuate indent wall panel crease lines separating the indent wall from the front wall and the second side wall, respectively;

a plurality of bottom wall panels adjacent to and contiguous with the front, rear and side wall panels, the bottom wall panels partitioned from their adjacent bottom wall panels by the vertical crease lines and separated from their respective side wall panels by a lower horizontal crease line, the bottom wall panels including a leading panel, a pair of opposing gusset panels, a trailing panel and a tab panel contiguous with the trailing panel; and a plurality of top panels adjacent to and contiguous with the front, rear and side wall panels, the top panels partitioned from their adjacent top panels by the vertical crease lines, the first side wall panel and the rear panel separated from their respective top panels by straight crease lines and the front wall panel and second side wall panel separated from their respective top panels by concave curved crease lines, wherein the indent wall panel crease lines intersect with one another and with the lower horizontal crease line and with the concave curved crease lines separating the front wall panel and second side wall panel from their respective top panels.

7. The blank in accordance with claim 6 wherein the straight crease lines separating the first side wall panel and the rear panel from their respective top panels are parallel to one another.

8. The blank in accordance with claim 7 wherein the straight crease lines separating the first side wall panel and the rear panel from their respective top panels are collinear.

9. The blank in accordance with claim 6 wherein the straight crease lines separating the first side wall panel and the rear panel from their respective top panels are at an angle to one another.

10. The blank in accordance with claim 6 wherein the concave curved crease lines are symmetrical about line through the middle of the respective front wall and second side wall panels.

11. The blank in accordance with claim 6 wherein the concave curved crease lines are asymmetrical about line through the middle of the respective front wall and second side wall panels.

* * * * *